US008137758B2

(12) United States Patent
Powell et al.

(10) Patent No.: US 8,137,758 B2
(45) Date of Patent: Mar. 20, 2012

(54) DIP COATING SYSTEM WITH STEPPED APRON RECOVERY

(75) Inventors: Robert Chad Powell, Pamplico, SC (US); Joseph A. Oliver, Jr., Florence, SC (US); Leon Dee Tanner, Brigham City, UT (US); Donald Ed Ryan, Fort Payne, AL (US)

(73) Assignee: Nucor Corporation, Charlotte, NC (US)

( * ) Notice: Subject to any disclaimer, the term of this patent is extended or adjusted under 35 U.S.C. 154(b) by 683 days.

(21) Appl. No.: 11/937,226

(22) Filed: Nov. 8, 2007

(65) Prior Publication Data

US 2009/0123658 A1 May 14, 2009

(51) Int. Cl.
*B05B 7/00* (2006.01)
*B05D 1/18* (2006.01)

(52) U.S. Cl. ..... 427/430.1; 118/429

(58) Field of Classification Search ..... 118/429; 427/430.1

See application file for complete search history.

(56) References Cited

U.S. PATENT DOCUMENTS

| | | | | | |
|---|---|---|---|---|---|
| 839,719 | A | | 12/1906 | Broderick | |
| 2,444,144 | A | | 6/1948 | Ransburg | |
| 2,875,094 | A | * | 2/1959 | Bloem et al. | 427/391 |
| 3,467,546 | A | * | 9/1969 | Page et al. | 427/601 |
| 3,687,158 | A | * | 8/1972 | Layton | 137/551 |
| 4,248,353 | A | * | 2/1981 | Budzich et al. | 212/331 |
| 4,403,479 | A | * | 9/1983 | Rasovich | 62/63 |
| 4,407,229 | A | * | 10/1983 | Sanborn | 118/702 |
| 4,560,592 | A | | 12/1985 | Friedland | |
| 4,635,584 | A | * | 1/1987 | Obermann | 118/64 |
| 5,094,891 | A | | 3/1992 | Wren | |
| 5,849,321 | A | * | 12/1998 | Linnonmaa | 427/424 |
| 5,902,402 | A | | 5/1999 | Durst et al. | |
| 6,001,216 | A | * | 12/1999 | Lee | 156/345.18 |

(Continued)

FOREIGN PATENT DOCUMENTS

JP 62023479 A * 1/1987

(Continued)

OTHER PUBLICATIONS

International Search Report and Written Opinion in PCT/US2008/082345, dated Jun. 30, 2009.

*Primary Examiner* — Dah-Wei Yuan
*Assistant Examiner* — Charles Capozzi
(74) *Attorney, Agent, or Firm* — Moore and Van Allen; Jeffrey R. Gray

(57) ABSTRACT

A coating apparatus and method of using for use in dip coating an article may have a container with opposing sides and a volume capable of holding a liquid coating material and at least one article to be coated by the material, and a stepped apron adjacent at least one of the opposing sides of the container, the stepped apron capable of holding the liquid coating material to a depth sufficient to maintain the material in the liquid state and receiving the liquid coating material dripping from at least one coated article positioned above the stepped apron; and at least one support member above the container capable of holding at least one article to be coated by dipping in the container. The apparatus may include localized heating of the article, such as by spot welding, and air cooling of the article using a cooling system having at least one fan and a conveyor before the article is dipped in the container containing the liquid coating material and subsequently dried.

13 Claims, 4 Drawing Sheets

U.S. PATENT DOCUMENTS

| | | | |
|---|---|---|---|
| 6,139,708 | A | 10/2000 | Nonomura et al. |
| 6,174,423 | B1 | 1/2001 | Wood et al. |
| 2002/0162749 | A1 | 11/2002 | Emmonds |
| 2006/0196414 | A1 | 9/2006 | Schuhmacher et al. |
| 2007/0036907 | A1 | 2/2007 | Swindler |

FOREIGN PATENT DOCUMENTS

| | | |
|---|---|---|
| KR | 100680048 | 2/2007 |
| WO | 9701176 | 1/1997 |

* cited by examiner

DIP COATING SYSTEM WITH STEPPED APRON RECOVERY

BACKGROUND AND SUMMARY OF THE DISCLOSURE

This invention relates to dip coating, and more particularly to an apparatus and method for recovering excess coating material to reduce waste and reduce emission of volatile organic compounds.

Dip coating systems and apparatus are well known in the prior art. However, the need continues for systems and methods improving upon desired performance properties and lowering application costs. Increasingly both manufacturers and customers have been concerned with the environmental impact of products and production methods.

The environmental impact of dip coating systems stems from the composition of the coating materials and the volatile organic compounds (VOCs) that are emitted in the coating process. Improvements in coating materials resulting in lower VOC content have only partially addressed the problem. The need to protect products from corrosion, particularly metals such as iron and steel, may necessitate the continued use of dip coating materials containing VOCs and the continued need to further control of emissions of VOCs.

Additionally, dip coating systems may pose potential inefficiencies and workplace hazards. Personnel working near these dip coating systems take steps to ensure dripping coating material is captured or contained to the extent possible. Coating material dripping from a coated article may fall onto the factory floor causing waste, may require clean-up, and may damage the workplace. In facilities with multiple dip coating systems, the hazard is compounded with the risk of coating material dripping from a piece in one coating line or system contaminating the coating material and process in an adjacent coating line.

Dip coating systems of the prior art have not adequately addressed these concerns. A common solution previously used was a drip tray or drip sheet to capture excess coating material dripping from coated articles. One prior dip tank is shown in FIG. 1 where an article would be dipped in a tank below the surface of a coating material and subsequently positioned over a drip tray that captured dripping coating material. In the dip tank of FIG. 1, the drip tray was attached to one side of the tank; however, in the past other dip tanks have used a free standing or mobile drip tray or sheet (See U.S. Pat. No. 5,902,402). Although previous drip trays or sheets may have addressed some of the containment concerns, coating material drying on these drip trays or sheets created waste that had to be disposed of in accordance with strict government regulations. Moreover, the created waste itself as well as VOCs released during drying exacerbated the environmental impact of the process and reduced the capacity of a dip coating line operated under an emission permit setting VOC limits. The dried waste and the emissions had to be counted within the emission limits of VOCs under the permit.

Moving the coated article to a separate drip station (See U.S. Pat. No. 6,837,933) only exacerbated the problem since there was additional waste and VOC production in the transfer, as well as increased risk of contaminating adjacent systems. An alternative to moving the coated article was holding the coated article above the dip tank. This solution reduced the risk of contamination in transfer, but reduced the production capacity of the line and increased the coating costs, since significant drying time was required.

The present disclosure substantially reduces coating waste that must be considered in dip coating given products, and in turn markedly increases the production capacity of a dip coating line operating under given emission permits. A dip coating apparatus is disclosed comprising:

a container having opposing sides and a volume capable of holding a liquid coating material and at least one article to be coated by the liquid coating material, and a stepped apron adjacent at least one of the opposing sides of the container, the stepped apron capable of holding the liquid coating material to a depth sufficient to maintain the coating material in the liquid state and receiving the liquid coating material dripping from at least one coated article positioned above the stepped apron; and at least one support member above the container capable of holding at least one article to be coated by dipping in the container.

The liquid coating material may circulate over the stepped apron and the container may have stepped aprons adjacent both opposing sides. The support member may comprise a crane or alternatively a conveyer. The support member may be capable of transferring a coated article from a position over the container to a position over the stepped apron. Moreover, the support member may comprise a rack capable of supporting a coated article over the stepped apron.

This dip coating apparatus markedly increases the production capacity of a coating line. The amount of waste coating material and VOCs that must be counted in the line's emission permit is substantially reduced for a given amount of coated production. The amount of coating waste is limited to splashing and incidental losses. Most of the coating material that drips from the coated articles during drying is returned to and maintained in the coating container in liquid state in its stepped apron, and at the same time the amount of VOC emissions during the drying operation is reduced if not eliminated. There will be an increase in VOCs emitted from the surface of the containers with the stepped apron, because of the larger surface area of the liquid coating material, but the net amount of waste coating material and VOCs that must be counted in the emission limits of the environmental permit will be markedly reduced, and the production capacity of the dip coating apparatus will be correspondingly increased.

Also disclosed is a method of coating an article comprising the steps of:

assembling a container having opposing sides and a volume capable of holding a liquid coating material and at least one article to be coated by the liquid coating material, and a stepped apron adjacent at least one of the opposing sides of the container, filling the stepped apron with the liquid coating material to a depth sufficient to maintain the coating material in the liquid state and receiving the liquid coating material dripping from at least one coated article positioned above the stepped apron; and using the support member to lower an article into the container to coat the article with the coating material;

lifting the coated article above the liquid coating material surface using the support member; and holding the coated article over the stepped apron for a decided period.

The method of coating an article may also comprise transferring the coated article from a position over the container to a position over the stepped apron. The step of transferring the coated article may be accomplished be a crane or alternatively by a conveyer.

The step of holding the coated article over the stepped apron may be accomplished by a crane or by a rack. The step of assembling the coating apparatus may also comprise stepped aprons adjacent both opposing sides of the container.

The method of coating an article may also comprise holding the coated article over the second stepped apron for a decided time or circulating the liquid coating material over the stepped apron.

The method of dip coating an article may further comprise the steps of assembling a cooling system comprising a conveyor and at least one fan and cooling the article to a temperature less than about 200° F. (about 93° F.) before lowering an article into the container by using the support member to coat the article with the coating material. These steps are particularly useful where the method involves increasing the temperature of at least portions of the articles by, for example, welding or heat treating. These steps enable the application of a more uniform coating on the article since spot welds and other locally heated areas are cooled before coating.

The step of assembling a cooling system may comprise providing a plurality of rollers capable of supporting at least one article, and positioning each fan between two rollers to direct the airflow between the rollers. Also, prior to the cooling step, the method may further comprise the step of transferring the article by the conveyor to a position adjacent the fans.

DETAILED DESCRIPTION OF THE DRAWINGS

Figure 2:
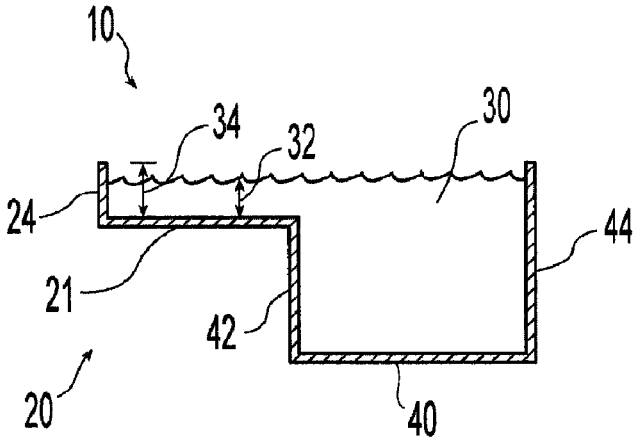
FIG. 2 is an elevated side view of the dip coating apparatus showing the vat, stepped apron, and coating material.

Referring now to FIG. 2, a dip coating apparatus 10 has a container 40 bounded by a first side 42 and a second side 44 opposite the first side 42. The container 40 has a volume capable of holding the coating material 30 and at least one article to be coated. Adjacent at least one of the opposing sides of the container 40 is a stepped apron 20. The stepped apron 20 may be in fluid communication with the container 40. The stepped apron 20 has a bottom surface 21 that may be submerged beneath the surface of the coating material 30 and bounded by the stepped apron outer wall 24. The bottom surface 21 may be sloped toward the container.

The stepped apron 20 may be integrally attached to the container 40 such that the bottom surface 21 is submerged beneath the surface level of the coating material 30 in the container a desired amount. A divider (not shown) may be positioned at least partially between the container 40 and the stepped apron 20. Alternately, the stepped apron 20 may be separated from the container 40 and may have a fluid level different than the fluid level in the container 40.

The outer wall 24 has a height indicated by height 34 on FIG. 2 suitable to retain a desired depth of liquid coating material. The height 34 of the outer wall 24 may be about 6 inches (about 15 centimeters). The depth 32 of the liquid coating material in the stepped apron 20 is a depth sufficient to maintain a substantial amount of the coating material over the stepped apron in a liquid state during the operation of the dip tank. A depth of one inch or more may be desired for some coating materials. The depth 32 may be about 3 to 5 inches (about 7.6 to 12.7 centimeters) for certain coating materials that may be employed. Additionally, the depth 32 of the coating material may be minimized in order to reduce material usage so long as a liquid state may be maintained.

Figure 3:
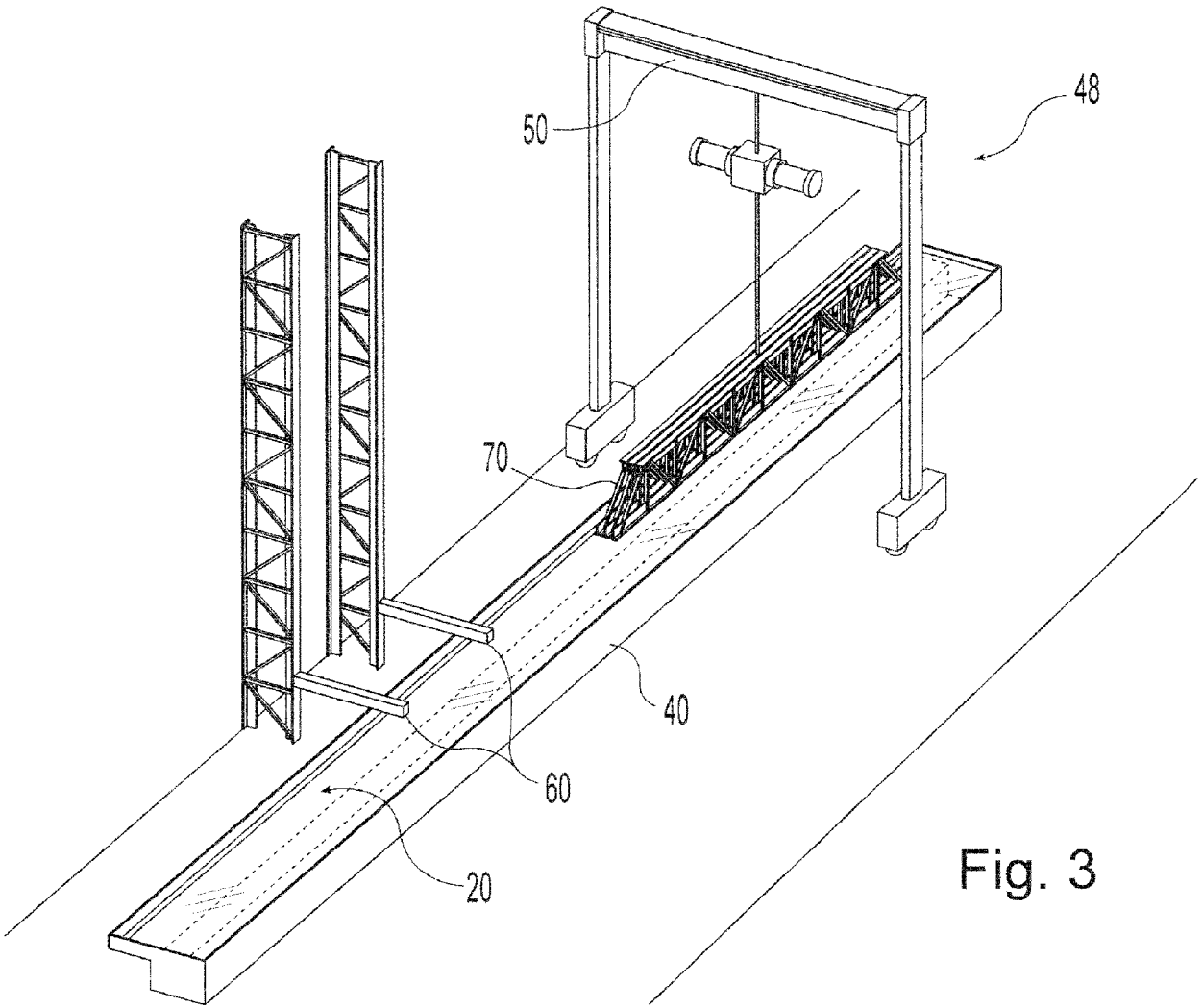
FIG. 3 is a perspective illustration of the coating apparatus illustrating orientation of an overhead crane.
Figure 4:
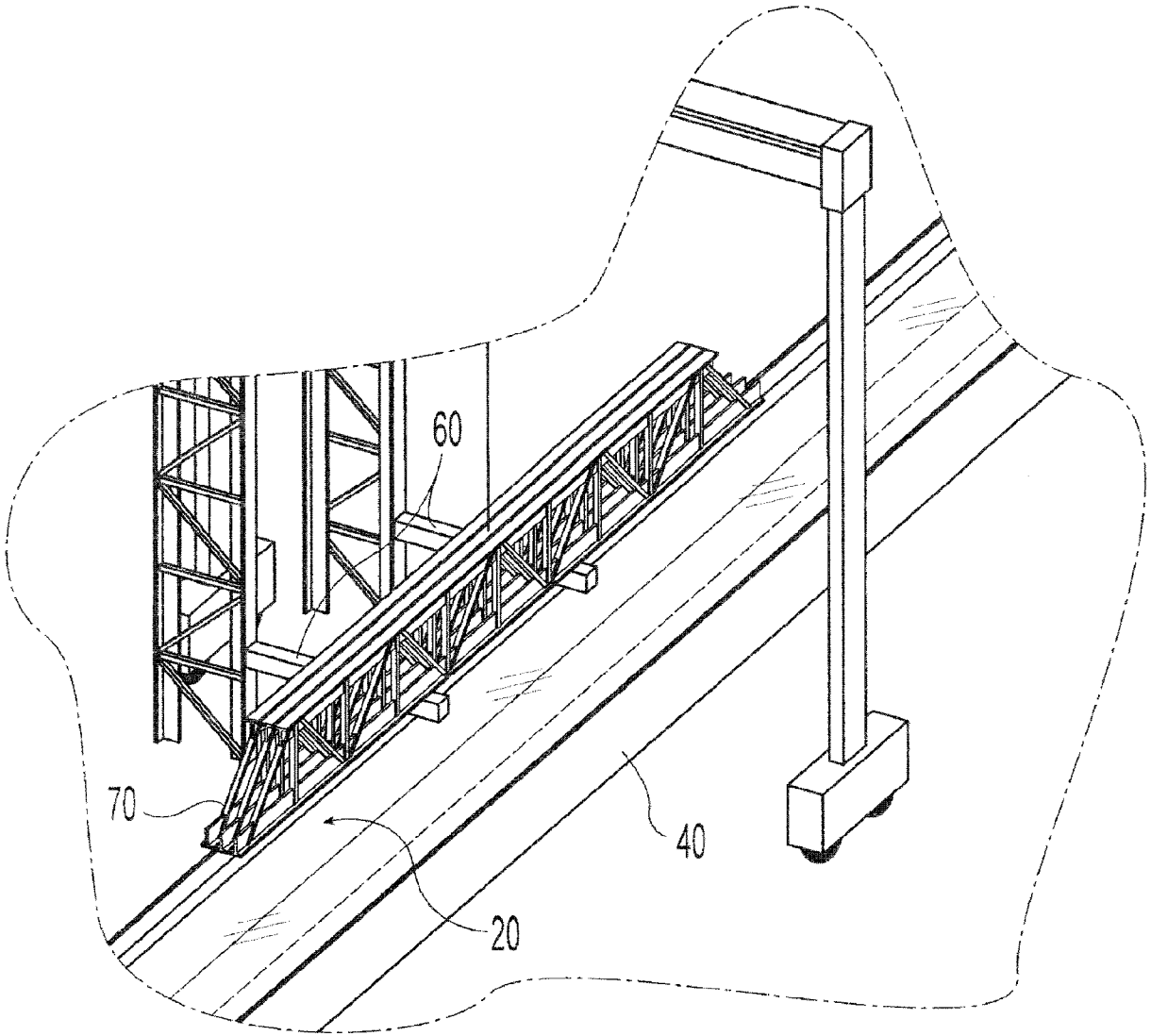
FIG. 4 is a perspective illustration of the coating apparatus illustrating use of a rack.

A support member 48 may be required to manipulate the article during the dip coating process. Referring now to FIG. 3, the support member 48 may comprise a crane 50 positioned over the container 40. The crane 50 may be capable of moving from the position over the container 40 to a position over the stepped apron 20. Alternately or in addition, the support member 48 may comprise a rack 60 as shown in FIG. 4. The rack 60 may hold a plurality of coated articles 70 over the stepped apron 20. In the example of FIG. 4, the rack 60 extends over the stepped apron 20 and enables articles to be raised and lowered into the container 40. However, the rack 60 may extend over the container 40 when the rack 60 enables articles to be dipped in the tank, such as for example but not limited to, where there exists adequate clearance between the rack 60 and the container 40, or the rack 60 moves to enable articles to be dipped into the tank.

Figure 5:
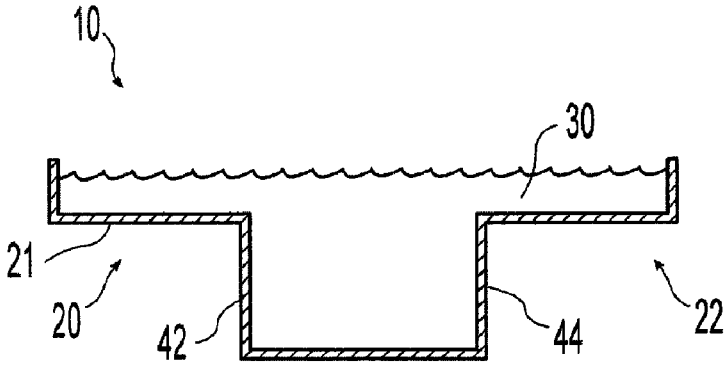
FIG. 5 is an elevated side view of the coating apparatus configured with two stepped aprons.

Referring now to FIG. 5, the dip coating apparatus 10 may have stepped aprons adjacent both opposing sides of the container 40. The first stepped apron 20 is adjacent the first side 42. The second stepped apron 22 is adjacent the second side 44.

The present dip tank improves upon the environmental and economic concerns present with the prior art. As shown in FIG. 2, the stepped apron 20 is submerged beneath the surface of the liquid coating material 30. When a coated article is held above the stepped apron, excess coating material drips into the liquid coating material in the stepped apron. This avoids excess coating material drying on a drip tray releasing VOCs and other emissions. Rather than excess coating material becoming a waste product, excess coating material may be recovered in the stepped apron and may be used for coating additional articles. This reduces waste produced during the dip coating process.

The coating material 30 may be circulated over the stepped apron 20 to maintain the coating material 30 in a liquid state and to maintain proper mixture and avoid settling of solid materials, which may occur with some coating materials. The coating may be circulated between the container 40 and the stepped apron 20. The coating material may be circulated using a pump. The coating material in the stepped apron may also be mixed with the coating material in the container. Additionally, coating material 30 may be added to the dip coating apparatus 10 to maintain a level of coating material in the container 40 and stepped apron 20 as desired.

The viscosity of the coating material along with temperature, humidity and other environmental factors may be one factor that determines the time a coated article must be allowed to dry before it can be moved to another location without dripping. The size of the stepped apron 20 may accommodate more than one article dripping while an article is being dipped in the container 40. If additional dripping space is required, the second stepped apron 22 may be added adjacent the second side 44 of the container 40. The ability to enlarge the stepped aprons and to utilize more than one stepped apron may make the apparatus cost effective by allowing the configuration to be optimized for combinations of article size, dip time, and dripping time.

The material from which the container, opposing sides, and stepped apron are made should be chosen based upon the requirements of the coating material employed. The coating material may be, for example, a paint, primer, degreaser, chemical cleaner or other substance appropriate for a dip coating process. Each coating material may have specifications for container composition, temperature, or other storage requirements that may be considered when constructing the dip coating apparatus.

The support member 48 may manipulate the article during the dip coating process. The support member may be the crane 50 capable of moving the article between the desired locations. Alternately, the support member 48 may be a conveyer (not shown). Many types of equivalent support members are known to those skilled in the art and combinations of more than one support member may be used. For any article to be coated, a primary consideration is the ability of the support member to manipulate the article between the container 40 and the stepped apron 20.

As shown in FIG. 4, the rack 60 may be capable of holding at least one coated article above the stepped apron 20. Coated articles held by the rack may drip excess coating material onto the stepped apron. The rack may have a fixed size or may be adjustable to accommodate multiple types of coated articles. Also, the rack may be fixed in location or moveable for use in multiple applications or with multiple dip coating apparatuses.

FIGS. 3 and 4 illustrate a configuration of the dip coating apparatus adapted for coating articles that are long and narrow. Any specific embodiment however may be adapted to the general shape of the article to be coated to minimize the volume of coating material required and maintain the cost effectiveness of the dip coating process.

The coating material 30 provided in the dip coating apparatus 10 may be an aqueous coating material comprising at least one resin and a desired composition of emulsifiers or surfactants. The aqueous coating material may have a solids content in the range of about 50% to about 70% by weight and from about 35% to about 55% by volume. The coating material 30 may have a VOC content of less than about 120 grams per liter excluding water, and have a viscosity in the range of from about 14 to about 22 seconds measured by #2 Signature Zahn Cup. Further, the coating material 30 may include one or more additives as desired, such as for example but not limited to biocides, pigments, adhesion promoters, corrosion inhibitors, and wetting agents.

If desired, the resin used in the aqueous coating material may have density of between about 7.8 pounds per gallon (0.936 kg per liter) to about 8.2 pounds per gallon (0.984 kg per liter), less than 1% volatile matter after 2 hours @ 100° C., and a viscosity of 600-1700 centipoise @ 25° C. The resin may comprise one or more polymerized C-5 hydrocarbons, C-9 hydrocarbons, or both, and a liquid drying oil. The liquid drying oil may contain at least one copolymer containing one monomer with at least one diallylic group and at least 50% of one or more long-chain di-unsaturated acids such as linoleic acid, 35% of one or more long-chain mono-unsaturated acids such as linolenic acid, oleic acid, and others.

The surfactant and emulsifier may comprise a sorbitan fatty ester or a fatty acid.

Solids by weight in the aqueous coating material may be in the range of from about 50 to about 70 wt %, and more particularly may be between about 55 to about 65 wt %. Alternately, the solids by weight may be between about 57 to about 60 wt %. When measured by volume, the solids content may be between about 35% to about 55% by volume.

Viscosity of the aqueous coating material, as measured by using #2 Signature Zahn Cup, may be in the range of from about 14 seconds to about 22 seconds, and more particularly may be between about 15 seconds to about 19 seconds. Alternately, the viscosity may be between about 16 seconds to about 18 seconds using #2 Signature Zahn Cup.

The aqueous coating material may have less than 3.0 pounds per gallon (0.36 kg/liter) of VOCs. Alternately, the aqueous coating material may have less than 1.0 pound per gallon (0.12 kg/liter) of VOCs.

The solids can be distributed in the water based (aqueous) system by many methods including but not limited to emulsification, suspension, dispersion, blending and others.

The dip coating apparatus 10 may be used with a method for treating articles made from metal, such as steel, to provide a coating that protects the metal from corrosion. A method for treating a metal surface of an article with an aqueous coating material may comprise providing the aqueous coating material; making an application of the aqueous coating material to the metal surface; removing any excess of the aqueous coating material from the article; and drying.

Alternately, the dip coating apparatus 10 may be used with a method for treating a steel surface of a joist with an aqueous coating material comprising providing the aqueous coating material; dipping the joist into a container containing the aqueous coating material; removing any excess of the aqueous coating material from the joist; and drying; wherein the aqueous coating material comprises water, at least one resin, and at least one fatty ester emulsifier or one fatty acid surfactant; the resin comprises one or more polymerized C-5 hydrocarbons, polymerized C-9 hydrocarbons, or both, and a liquid drying oil containing at least one copolymer containing one monomer with at least one diallylic group and at least 50% of one or more long-chain di-unsaturated acids, 35% of one or more long-chain mono-unsaturated acids; the resin having a density of about 7.8 pounds per gallon (0.936 kg per liter) to about 8.2 pounds per gallon (0.984 kg per liter), less than 1% volatile matter after 2 hours @ 100° C., and a viscosity of 600-1700 centipoise @ 25° C.; and the aqueous coating material having a solids content in the range of from about 55% to about 65% by weight, from about 40% to about 50% by volume; a VOC content of not more than 113 grams per liter excluding water; a viscosity in the range of from about 14 seconds to about 20 seconds measured by #2 Signature Zahn Cup; and the joist exhibits 100 or more hours of salt spray resistance in accordance with and as measured by the testing method ASTM-B-117.

The methods for treating articles may be used for treating metals and alloys, such as but not limited to steel, iron, aluminum, nickel, and others. The metal articles to be coated may be of various shapes and sizes. The method may be used for treating structural steel joists or other structural steel parts. Any shape of such joists, joist girders, open web and long span steel joist, cold formed steel framing and the like can be treated in the dip coating apparatus 10.

The metal surface of an article may be cleaned or treated prior to making an application of the aqueous coating material, or the article may undergo other processing. Cleaning or other processes may include, for example but not limited to, chemical treatments, water cleaning, brazing, sand blasting, welding, and heat treating.

In some embodiments, the process may involve increasing the temperature of at least portions of the articles by, for example, welding or heat treating. When the temperature of the article is higher than a desired dipping temperature, the article may be cooled before dip coating. For example, an embodiment may involve spot welding to about 400° F. (about 204° C.) while aqueous coating materials may boil or evaporate when the article being dipped has a temperature greater than about 212° F. (about 100° C.), degrading the coating material.

Figure 6:
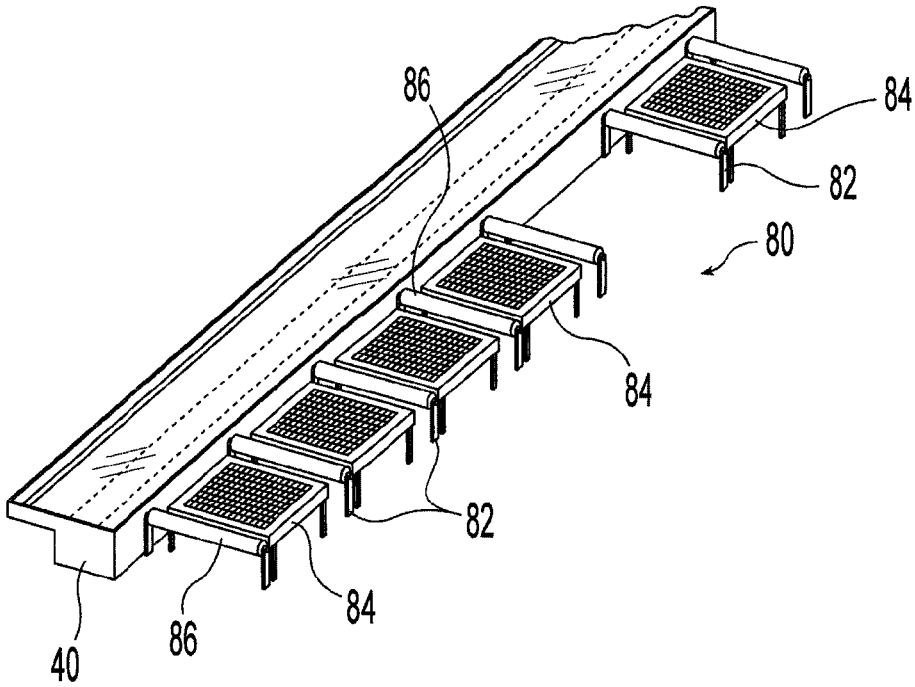
FIG. 6 is a perspective illustration of the coating apparatus and a cooling system.
Figure 7:
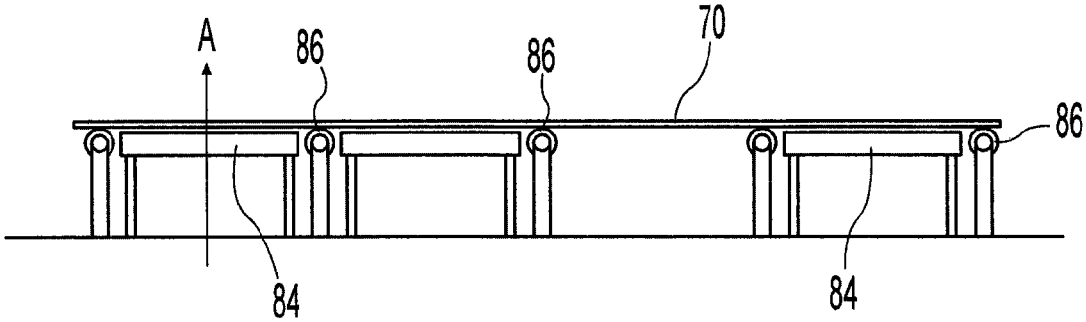
FIG. 7 is an elevated side view of the cooling system.

In such embodiments, the dip coating apparatus 10 may be used in combination with a cooling system 80. As shown in FIGS. 6 and 7, a conveyor 82 may be provided to convey articles 70 adjacent one fan 84, or alternately, more than one fan 84, providing an airflow. The fans 84 may be oriented in any desired direction. The fans 84 may be placed in a position to provide an upward airflow as indicated by the arrow marked as "A" in FIG. 7. Alternately, the fans may be positioned in any orientation capable of directing the airflow over the articles 70 provided by the conveyor 82. In any event, the airflow from the fans 84 can reduce the temperature of the article before dipping to a temperature below about 212° F. (about 100° C.) so that the coating of the article by dipping in aqueous coating material will not degrade the material upon dipping in the tank.

The number of fans 84 in the cooling system 80 may be determined by factors including the size of the fan, the size and shape of the article to be cooled, and the desired degree of change in temperature desired. As shown in FIG. 6, a plurality of fans 84 may be provided with a roller conveyor. The fans 84 may be placed between rollers 86 of the conveyor 82. Each fan 84 may be placed in between consecutive rollers, between every other roller, or in another pattern or arrangement as desired. As shown in FIG. 6, some fans may be placed in between consecutive rollers, while some fans may be located between every other roller. The fans 84 may be propeller fans, centrifugal fans, blowers, or any other suitable air handling device capable of providing an airflow in a desired direction. In the example of FIGS. 6 and 7, the fans may be fans having a diameter of about 48 inches (about 1.2 meters) capable of moving up to about 22,400 cubic foot (about 634 cubic meters) of air per minute or more. The fans may be selected to provide a desired velocity and/or volume of airflow a predetermined distance from the fan, such as but not limited to the distance between the fan 84 and the conveyor 82. A grate may be provided adjacent the fan to keep objects from contacting the rotating fan. Further, the grate may be shaped to direct the airflow in a desired direction.

The conveyor 82 may be a roller conveyor, a link conveyor, a belt conveyor, hanging conveyor or any other type of conveyor for moving the articles 70 into the airflow provided by the fans 84.

In any event, the duration for dipping of the article in the container 40 may be varied as desired. An article may remain immersed in the coating material 30 in container 40 from between less than a second to several minutes as desired. For large articles, such as steel joists, the duration may be between about 1 second to about 60 seconds, and more particularly between about 5 seconds to about 20 seconds. Alternately, the duration of dipping may be between about 10 seconds and about 15 seconds.

After submersion into the coating material in a dipping process, the article may be moved to a position over the stepped apron 20 to allow excess of the coating material to drain off. The period for draining excess coating material may be the range of from about 10 seconds to about 20 minutes. After sufficient draining time, the coated article may be dried. The article may be air-dried in ambient air. Alternately, the coating may be dried using a forced air dryer.

The thickness of the coating on a metal surface may depend on factors such as the particular coating material, the metal surface, the duration of dipping, temperatures, drying method and temperature, and many other factors. For dip coating, a thickness of coating may be in the range of about 0.5 mil (12.7 Mm) to about 1.5 mil (38.1 Mm). A metal surface or article may be coated more than one time to obtain a thicker coating, if desired.

Dip coating may be carried out when the entire article is completely submerged into the coating material 30 in the container 40. To avoid overflows and/or spills, the container 40 may be large enough to accept the article without overflowing. The dipping may be performed at a convenient or suitable temperature. The temperature of the coating material in the container may be maintained at a temperature at or below the boiling point of the coating material and above the freezing temperature of the coating material.

Figure 1:
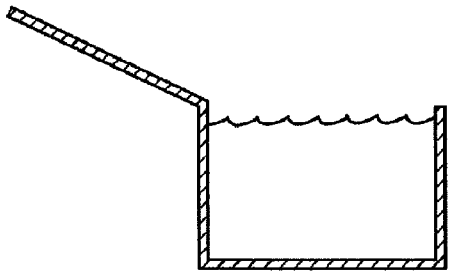
Fig. 1 (Prior Art)
FIG. 1 is an elevated side view of a prior art dip coating system utilizing a drip tray.

The dip tank of FIG. 2 may reduce the emission of volatile organic compounds when compared to the dip tank of FIG. 1. When coating materials containing VOCs are utilized, a reduction in VOC emissions may be achieved using the present dip coating system by minimizing the waste produced by the dip coating process. Minimizing the emission of VOCs may involve reducing evaporation and conserving the coating material that is the source of the VOCs. The dip tank of the present disclosure may reduce evaporation of coating materials to the environment thereby reducing the release of VOCs.

The stepped apron of the present disclosure may facilitate reductions in VOC emissions over the prior drip tray or drip sheet. Coating materials containing VOCs release the VOCs when the coating material dries. Therefore, minimizing the amount of coating material that dries or evaporates may result in a reduction in VOCs released into the environment. Evaporation of the VOCs and other portions of the coating material occurs when excess coating material is allowed to dry on a drip tray or drip sheet. As a result, the total amount of VOCs released from the drying coating material may be proportional to the total surface area over which the coating material dries. Similarly, repeated coatings of the same surface by multiple coating cycles through a production run may each release VOC content proportional to the surface area coated.

Further, an emission permit regulating the VOC limit from the coating line or system may require accounting for the solidified coating material or waste that dried on a prior drip tray or drip sheet. By reducing the amount of coating material waste that dries releasing VOCs, the capacity of the coating line under a given emission permit increases.

In operation, the stepped apron may reduce the amount of coating material that dries other than on the article. For example, in the past, during a work-day a dip coating apparatus may be used in multiple dip cycles to coat a plurality of articles. Each cycle of the coating process would result in excess coating material being dripped onto a drip tray or drip sheet where much of the excess coating material would have dried. As a result, the drip tray or drip sheet in the past would have been coated multiple times during the work-day with each coating releasing VOC content proportional to the surface area of the drip tray or drip sheet. The dried coating material created waste requiring disposal in accordance with government regulations further reducing the cost effectiveness of the dip coating system.

In contrast, the stepped apron of the present disclosure reduces the amount of coating material that dries other than on the article, and therefore may reduce the total emissions of VOCs over the course of the example work-day. Rather than the coating material drying on the drip tray or drip sheet with each cycle, the stepped apron enables liquid coating material falling from a dripping article to fall back into the liquid coating material in the container. By maintaining the coating material in a liquid state, fewer VOCs may be released as a result of evaporation.

Additionally, the total surface area of the stepped apron may be less than the total surface area of the drip tray or drip sheet of FIG. 1. The reduced surface area of the stepped apron may therefore reduce the amount of VOCs evaporating directly from the surface of the coating material in the stepped apron relative to a drip tray or drip sheet. Further, the liquid coating material in the stepped apron may be circulated and the temperature of the liquid coating material in the stepped apron may be controlled so as to further reduce evaporation and release of VOCs directly from the coating material.

Although the invention has been shown and described with respect to a best mode embodiment thereof, it should be understood by those skilled in the art that various changes, omissions, and additions may be made to the form and detail of the disclosed embodiment without departing from the spirit and scope of the invention, as recited in the following claims.

What is claimed is:

1. A method of dip coating an article comprising the steps of:

assembling a container having opposing sides and a volume holding a liquid coating material and at least one metal article to be coated by the liquid coating material, and a stepped apron adjacent at least one of the opposing sides of the container having a bottom adjoining one of the opposing sides of the container below the surface of the liquid coating material in the container and the stepped apron;

filling the stepped apron with the liquid coating material to a depth sufficient to maintain the coating material in the liquid state and receiving the liquid coating material dripping from at least one coated article positioned above the stepped apron; and lowering the metal article into the container by using a support member to coat the article with the coating material;

lifting the coated metal article above the liquid coating material surface and transferring the coated article from a position over the container to a position over the stepped apron using the support member; and holding the coated article over the stepped apron for a pre-determined period to allow excess coating material to drain off into the liquid coating material in the stepped apron.

2. The method of claim 1, the step of transferring the coated article being accomplished by a crane.

3. The method of claim 1, the step of transferring the coated article being accomplished by a conveyer.

4. The method of claim 1, the step of holding the coated article over the stepped apron being accomplished by a crane.

5. The method of claim 1, the step of holding the coated article over the stepped apron being accomplished by a rack.

6. The method of claim 1, the step of assembling the container further comprising:

stepped aprons adjacent both opposing sides of the container.

7. The method of claim 6, further comprising holding a second coated article over the second stepped apron for a predetermined time to allow excess coating material to drain off into the liquid coating material in the stepped apron.

8. The method of claim 1, further comprising circulating the liquid coating material over the stepped apron.

9. The method of claim 1, further comprising, before lowering an article into the container, the step of:

cooling the article to a temperature less than about 180° F. (about 82° F.).

10. A method of dip coating an article comprising the steps of:

assembling a cooling system comprising a conveyor and at least one fan;

assembling a container having opposing sides and a volume capable of holding a liquid coating material and at least one metal article to be coated by the liquid coating material, and a stepped apron adjacent at least one of the opposing sides of the container having a bottom adjoining one of the opposing sides of the container below the surface of the liquid coating material in the container and the stepped apron;

filling the stepped apron with the liquid coating material to a depth sufficient to maintain the coating material in the liquid state and receiving the liquid coating material dripping from at least one coated article positioned above the stepped apron; and cooling the metal article to a temperature less than about 200° F. (about 93° F.);

lowering the metal article into the container by using a support member to coat the article with the coating material;

lifting the coated article above the liquid coating material surface and transferring the coated article from a position over the container to a position over the stepped apron using the support member; and holding the coated article over the stepped apron for a pre-determined period to allow excess coating material to drain off into the liquid coating material in the stepped apron.

11. The method of claim 10, the step of assembling a cooling system further comprising providing a plurality of rollers supporting at least one article, and positioning each fan between two rollers to direct the airflow between the rollers.

12. The method of claim 10, prior to the cooling step, further comprising the step of:

transferring the article by the conveyor to a position adjacent the fans.

13. The method of claim 10 where before cooling the metal article, there is a step of increasing the temperature of at least portions of the articles.

* * * * *